US009783880B2

(12) United States Patent
Lin et al.

(10) Patent No.: US 9,783,880 B2
(45) Date of Patent: Oct. 10, 2017

(54) SLURRY AND A COATING METHOD

(71) Applicant: GENERAL ELECTRIC COMPANY, Schenectady, NY (US)

(72) Inventors: Dechao Lin, Greer, SC (US); David Vincent Bucci, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 312 days.

(21) Appl. No.: 14/133,969

(22) Filed: Dec. 19, 2013

(65) Prior Publication Data

US 2015/0176115 A1 Jun. 25, 2015

(51) Int. Cl.

| | |
|---|---|
| ***C23C 10/48*** | (2006.01) |
| ***C23C 10/56*** | (2006.01) |
| ***C23C 12/00*** | (2006.01) |
| ***C23C 10/60*** | (2006.01) |
| ***C23C 10/20*** | (2006.01) |

(52) U.S. Cl.

CPC ..... *C23C 12/00* (2013.01); *C23C 10/20* (2013.01); *C23C 10/60* (2013.01)

(58) Field of Classification Search

CPC ..... C23C 10/28; C23C 10/30; C23C 10/32; C23C 10/34; C23C 10/36; C23C 10/48; C23C 10/50; C23C 12/00; C23C 24/103; C23C 24/106; C23C 28/321; C23C 28/3455

See application file for complete search history.

(56) References Cited

U.S. PATENT DOCUMENTS 5,366,765 A * 11/1994 Milaniak ..... C23C 10/20 427/229
6,110,262 A * 8/2000 Kircher ..... C23C 10/26 106/14.21
6,444,054 B1 9/2002 Kircher et al.
(Continued)

FOREIGN PATENT DOCUMENTS

EP 1528117 A1 5/2005
EP 2441855 A2 4/2012

OTHER PUBLICATIONS

European Search Report and Opinion issued in connection with corresponding EP Application No. 14198242.1 dated May 4, 2015.

*Primary Examiner* — Lois Zheng
(74) *Attorney, Agent, or Firm* — McNees Wallace & Nurick LLC

(57) ABSTRACT

A slurry and a coating method are provided. The slurry includes, by weight, between 10% and 40% metal powder, between 10% and 15% activator, between 10% and 20% adhesive, between 10% and 20% thickener, up to 30% ceramic, and up to 25% binder. The coating method includes providing a slurry including, by weight, between 10% and 40% metal powder, between 10% and 15% activator, between 10% and 20% adhesive, between 10% and 20% thickener, up to 30% ceramic, and up to 25% organic polymer binder, providing a substrate, applying the slurry over a surface of the substrate to form a slurry coating, drying the slurry coating over the substrate, baking the substrate and the slurry coating, and curing the slurry coating over the substrate. The curing the slurry coating over the substrate transfers metal elements of the metal powder in the slurry to the substrate to form a coating on the substrate.

20 Claims, 4 Drawing Sheets

(56) References Cited

U.S. PATENT DOCUMENTS

| | | | | |
|---|---|---|---|---|
| 8,318,251 | B2 * | 11/2012 | Cavanaugh | C23C 10/18 427/250 |
| 2005/0064220 | A1 * | 3/2005 | Hasz | C23C 24/10 428/546 |
| 2005/0095358 | A1 * | 5/2005 | Park | C23C 10/30 427/140 |
| 2005/0265851 | A1 * | 12/2005 | Madhava | C23C 10/04 416/241 R |
| 2009/0126833 | A1 | 5/2009 | Cavanaugh et al. | |
| 2010/0136240 | A1 | 6/2010 | O'Connell et al. | |

* cited by examiner

SLURRY AND A COATING METHOD

FIELD OF THE INVENTION

The present invention is directed to a slurry composition and a coating method. More specifically, the present invention is directed to a slurry composition for diffusion coating, and a coating method for applying the slurry composition.

BACKGROUND OF THE INVENTION

Often, a coating is desired for a component having limited access and/or a smooth surface. Forming full coatings and/or evenly distributed coatings over these components can be difficult and inefficient. Often, components having surfaces with limited access, such as honeycomb shaped components, require a diffusion coating.

During diffusion coating, the coating material travels along the portions having limited access to form the coating. For example, the coating material travel through each of the hexagons in the honeycomb shaped component to form the coating over a surface within each hexagon. However, when the surface of the component to be coated includes a smooth surface, the coating material may slide over portions of the surface without adhering, leading to incomplete coatings, or uncoated portions of the surface.

One attempt to improve coatings includes multiple applications of the coating material. This can often lead to coatings having non-uniform thickness, and increases the cost of the coating process. Another attempt to improve coatings includes adding additional metal powder to increase the thickness of the coating material. The thicker gel increases the cost of the coating material, and therefore the cost of the coating process.

A coating material that does not suffer from one or more of the above drawbacks is desirable in the art.

BRIEF DESCRIPTION OF THE INVENTION

In one exemplary embodiment, a slurry for forming a diffusion coating on a surface of a component includes, by weight, between 10% and 40% metal powder, between 10% and 15% activator, between 10% and 20% adhesive, between 10% and 20% thickener, up to 30% ceramic, and up to 25% binder.

In another exemplary embodiment, a slurry for forming a diffusion coating on a surface of a component includes, by weight, between 10% and 40% Cr—Al powder, between 10% and 15% activator, between 10% and 20% polyethylene oxide, between 10% and 20% thickener, up to 30% ceramic, and up to 25% organic polymer binder.

In another exemplary embodiment, a coating method includes providing a slurry including, by weight, between 10% and 40% metal powder, between 10% and 15% activator, between 10% and 20% adhesive, between 10% and 20% thickener, up to 30% ceramic, and up to 25% binder, providing a substrate, applying the slurry over a surface of the substrate to form a slurry coating, drying the slurry coating over the substrate, baking the substrate and the slurry coating, and curing the slurry coating over the substrate. The curing of the slurry coating over the substrate transfers metal elements of the metal powder in the slurry to the substrate to form a coating on the substrate.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are a slurry composition and a coating method. Embodiments of the present disclosure, in comparison to slurry compositions and coating methods not using one or more of the features disclosed herein, decrease cost, increase efficiency of coating smooth surfaces, increase coating coverage of smooth surfaces, increase efficiency of coating honeycomb shaped articles, provide a more uniform coating thickness over smooth surfaces of the substrate, provide a coated substrate without post-heat treatment, or a combination thereof.

Figure 1:
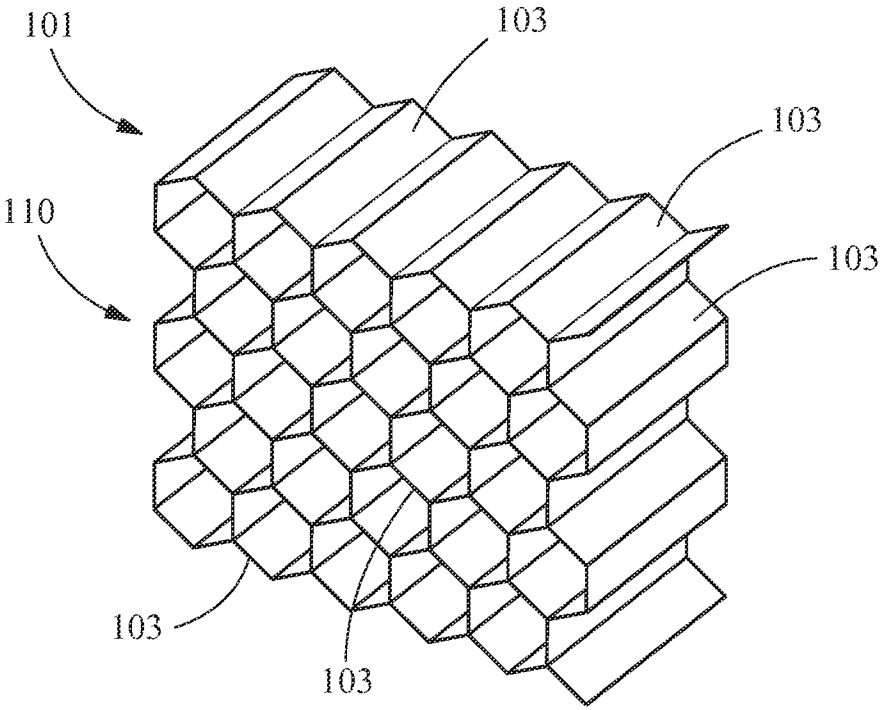
FIG. 1 shows a perspective view of a substrate according to an embodiment of the disclosure.
Figure 2:
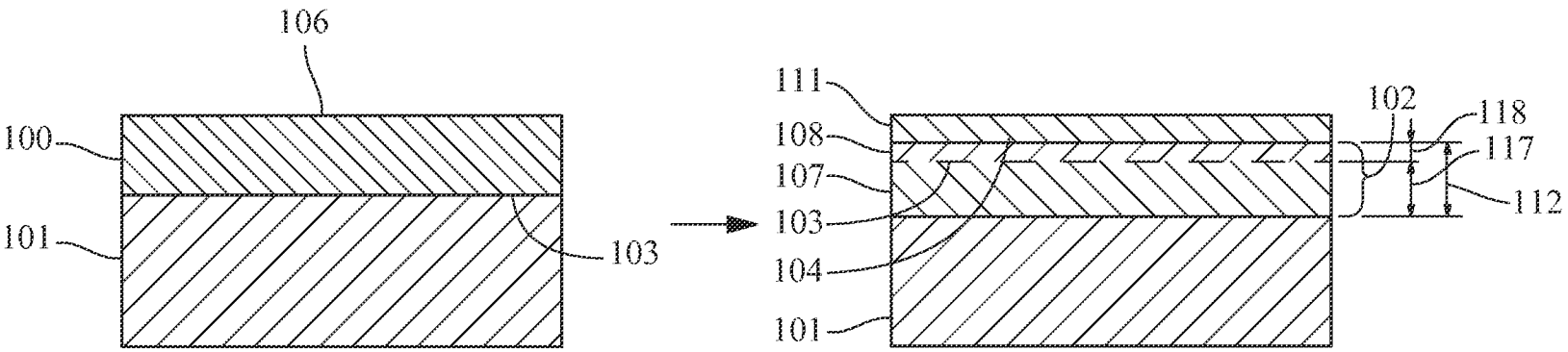
FIG. 2 is a cross sectional view of a slurry coating over a substrate forming a diffusion coating, during and after forming the coating.

Referring to FIG. 1 and FIG. 2, in one embodiment, a slurry 100 is provided for forming a diffusion coating 102 over a substrate surface 103 of a substrate 101. The substrate 101 includes any suitable substrate for applying the diffusion coating 102, such as, but not limited to, substrates having a smooth surface and/or difficult to reach surfaces, components that benefit from diffusion coatings, or a combination thereof. For example, suitable substrates include, but are not limited to, honeycomb seals 110, tubes, pipes, or turbine components with cooling holes. Smooth surface, as used herein, includes any surface having a surface finish with an average roughness of up to about 0.40 micrometers.

In one embodiment, the substrate 101 is formed of any suitable material, including, but not limited to, superalloys, such as iron, nickel, or cobalt based superalloys. The slurry 100 forms the diffusion coating 102 over the substrate surface 103 to reduce or eliminate exposure of the substrate surface 103 to hostile environments. The substrate surface 103 includes, but is not limited to, both the external surface of the substrate 101, as well as the difficult to reach surfaces, such as walls of each honeycomb section of the honeycomb seals 110, or internal surfaces of the tubes, pipes, or cooling holes. In another embodiment, the diffusion coating 102 is an aluminide coating that, when subjected to sufficiently high temperatures in an oxidizing atmosphere, develops a protective alumina ($Al_2O_3$) layer or scale (see FIG. 4) over the diffusion coating 102. The alumina layer or scale inhibits oxidation of the diffusion coating 102 and the underlying substrate 101.

The slurry 100 includes a metal powder, an activator, an adhesive, a thickener, a ceramic, and a binder. In another embodiment, the slurry 100 includes, but is not limited to, by weight, between 10% and 40% of the metal powder, between 10% and 15% of the activator, between 10% and 20% of the adhesive, between 10% and 20% of the thickener, up to 30% of the ceramic, and up to 25% of the binder. Increasing an amount of thickener increases a viscosity of the slurry 100, while increasing an amount of the binder decreases the viscosity of the slurry. Together, the adhesive and the thickener increase an adherence of the slurry 100 to the substrate surface 103. In another embodiment, the increased viscosity increases adherence of the slurry 100 to the substrate 101 having a smooth surface.

The metal powder in the slurry 100 includes any suitable metal powder for forming the diffusion coating 102 over the substrate surface 103. Suitable aluminum-containing metal powders include, but are not limited to, aluminide compounds such as metallic aluminum alloys. For example, metallic aluminum alloys include metallic aluminum alloyed with chromium, cobalt, iron, and/or another aluminum alloying agent with a sufficiently higher melting point so that the alloying agent does not deposit during the diffusion aluminiding process, but instead serves as an inert carrier for the aluminum of the donor material. After applying the slurry 100 over the substrate surface 103, curing the slurry 100 according to a coating method 200, described in detail below, volatilizes the activator and transfers metal elements of the metal powder to the substrate surface 103 to form the diffusion coating 102. For example, in one embodiment, curing the slurry 100 transfers the chromium and aluminum elements of the chromium-aluminum metal powder to the substrate surface 103 to form an aluminide coating over the substrate 101.

The activator includes any suitable activator for reacting with the metal powder to form a volatile halide that reacts at the substrate surface 103 and then diffuses into the substrate surface 103 to form the diffusion coating 102. Suitable activators include, but are not limited to, halide activators, such as ammonium chloride ($NH_4Cl$), ammonium fluoride ($NH_4F$), ammonium bromide ($NH_4Br$), and methyl chloride ($CH_4Cl$). For example, in one embodiment, methyl chloride reacts with aluminum in the metal powder to form a volatile aluminum halide (e.g., $AlCl_3$) that reacts at the substrate surface 103 to deposit the aluminum, which then diffuses into the substrate 101 to form the diffusion aluminide coating. A type of aluminide coating is determined by selection of the activator. For example, chloride activators promote a slower reaction to produce a thinner, whereas fluoride activators promote a faster reaction capable of producing a thicker coating.

The adhesive includes any suitable adhesive for increasing adhesion of the slurry 100 to the substrate 101, and/or increasing the viscosity of the slurry 100. In one embodiment, suitable adhesives include, but are not limited to, wet adhesives. For example, in another embodiment, the adhesive includes a polyether, such as polyethylene oxide, which is water-soluble. The thickener includes any suitable compound for increasing the viscosity of the slurry 100. For example, in one embodiment, the thickener includes alumina. Increasing the amount of the thickener to increase the viscosity of the slurry 100 permits increasing the viscosity of the slurry 100 without modifying an amount of the metal powder.

The binder includes any suitable braze binder, such as, but not limited to, an organic polymer. In one embodiment, the braze binder decreases the viscosity of the slurry to reduce or eliminate a setting of the metal powder and increase a homogeneity of the slurry 100. In another embodiment, the binder is burned off entirely at temperatures below a diffusion treatment temperature without reacting the activator with the metal powder.

The ceramic includes any suitable ceramic powder for reducing or eliminating sintering of the metal powder. Suitable ceramic powders include, but are not limited to, zirconium oxide, aluminum oxide, boron nitride, titanium dioxide, aluminum nitride, or a combination thereof. By reducing or eliminating sintering of the metal powder, the ceramic facilitates the formation of a uniform coating by the metal powder and/or facilitates removal of a coating residue 111 formed during the coating method 200. For example, mixing the ceramic into the slurry 100 reduces or eliminates a sticking together of particles in the metal powder, which increases a uniformity of the diffusion coating 102 and/or facilitates removal of the coating residue 111.

In one embodiment, the metal powder, the thickener, the activator, and the ceramic include a particle size of between about +200 mesh (74 micrometers) and about −100 mesh (149 micrometers). Each of the components includes a substantially similar particle size as compared to the other components.

Referring to FIGS. 1-5, in one embodiment, the coating method 200 includes providing the slurry 100 (step 210), providing the substrate 101 (step 220), applying the slurry 100 over the substrate surface 103 to form a slurry coating 106 (step 230), drying the slurry coating 106 over the substrate 101 (step 240), baking the substrate 101 and the slurry coating 106 (step 250), and curing the slurry coating 106 over the substrate 101 (step 260) to form a coated substrate including the diffusion coating 102.

The viscosity of the slurry 100 and/or the adhesive in the slurry 100 provide a consistency that adheres to smooth surfaces to provide full, or substantially full slurry coatings over the substrate surface 103 having the smooth surfaces. The consistency of the slurry 100 permits application of the slurry 100 over the substrate surface 103 by a variety of methods, including, but not limited to, spraying, dipping, brushing, injection, or a combination thereof. For example, in one embodiment, the substrate 101 is dipped into the slurry 100 to apply (step 230) the slurry 100 over the substrate surface 103. In another embodiment, increasing the amount of the thickener in the slurry 100 increases the viscosity of the slurry 100 which decreases a rate at which the slurry 100 moves over the substrate surface 103. Decreasing the rate at which the slurry 100 flows over the substrate surface 103 increases coverage of the slurry coating 106 over the substrate surface 103.

After drying the slurry coating 106 over the substrate 101 (step 240) for any suitable amount of time, baking of the substrate 101 and the slurry coating 106 (step 250) burns off the binder and the adhesive. A suitable amount of time for drying the slurry coating 106 over the substrate 101 (step 240) includes, but is not limited to, 10 hours, 5 hours, between 5 hours and 10 hours, 4 hours, 2 hours, between 2 hours and 5 hours, 1 hour, or any combination, sub-combination, range, or sub-range thereof. The baking (step 250) includes heating the substrate 101 and slurry coating 106 to any suitable temperature for burning off the organic binder and the organic adhesive, such as, but not limited to, a temperature between 300° F. and 800° F. (150° C. and 425° C.).

Once the binder and the adhesive have been burned off, the substrate 101 and the slurry coating 106 are heated to any suitable diffusion treatment temperature to form a coated substrate. Suitable diffusion treatment temperatures include, but are not limited to, between 1200° F. to 2100° F. (650° C.

to 1150° C.). Heating the substrate 101 and the slurry coating 106 to the diffusion temperature cures (step 260) the slurry coating 106 over the substrate 101 by volatilizing the activator and transferring the metal elements of the metal powder in the slurry 100 to the substrate 101. In one embodiment, the metal element diffuses into the substrate 101 to form at least a portion the diffusion coating 102. For example, in one embodiment, during curing (step 260) the activator is volatilized, the aluminum halide is formed, and the aluminum is deposited on the substrate surface 103 to form the aluminide coating. The diffusion of the metal element to form the diffusion coating 102 replaces the substrate surface 103 with a coated substrate surface 104 at an external portion of the diffusion coating 102. In one embodiment, the curing (step 260) forms the coated substrate without post heat-treating the substrate 101.

In one embodiment, the substrate 101 is held at the diffusion treatment temperature for any suitable duration to form the diffusion coating 102. Suitable durations include, but are not limited to, up to 10 hours, up to 8 hours, between 1 hour and 8 hours, 4 hours, or any combination, sub-combination, range, or sub-range thereof. In another embodiment, the diffusion treatment temperature is selected to form the diffusion coating 102 including both an inward portion 107 and an outward portion 108. The inward portion 107 extends into the substrate 101 from the substrate surface 103, forming various intermetallic and metastable phases during the coating reaction as a result of compositional gradients and changes in elemental solubility in the local region of the substrate 101 near the substrate surface 103. These phases are distributed in a matrix of the substrate material. The outward portion 108 is formed over the inward portion 107 and includes environmentally-resistant intermetallic phases such as, MAl where M is iron, nickel or cobalt, depending on a material of the substrate 101. A chemistry of the outward portion 108 may be modified by the addition into the slurry of elements, such as chromium, silicon, platinum, rhodium, hafnium, yttrium and zirconium, for the purpose of modifying the environmental and physical properties of the diffusion coating 102.

The inward portion 107 includes an inward coating thickness 117 and the outward portion 108 includes an outward coating thickness 118. Together, the inward coating thickness 117 and the outward coating thickness 118 form a predetermined thickness 112 of the diffusion coating 102. The predetermined thickness 112 includes, but is not limited to, between 20 microns and 135 microns, between 35 microns and 105 microns, between 45 microns and 90 microns, between 50 microns and 80 microns, or any combination, sub-combination, range, or sub-range thereof. In one embodiment, inward coating thickness 117 includes, but is not limited to, between 75% and 98% of the predetermined thickness 112 of the diffusion coating 102. In another embodiment, the outward coating thickness 118 includes, but is not limited to, between 2% and 25% of the predetermined thickness 112 of the diffusion coating 102.

In one embodiment, application (step 230) of the slurry 100 over the substrate 101 forms the slurry coating 106 having a non-uniform thickness. In another embodiment, the slurry coating 106 having the non-uniform thickness forms the diffusion coating 102 with a uniform or substantially uniform thickness, such as the predetermined thickness 112. For example, the slurry 100 applied (step 230) over the substrate 101 to form the slurry coating 106 with thicknesses of between 250 microns to 25000 microns and greater may produce the diffusion coating 102 having thicknesses that vary by as little as 10 microns or less. Forming coatings with uniform or substantially uniform thicknesses from the slurry 100 applied (step 230) with non-uniform thicknesses permits the formation of the diffusion coating 102 with uniform or substantially uniform thicknesses from any of the application methods described herein (e.g., dipping, brushing, injecting).

Varying the diffusion treatment temperature varies the inward coating thickness 117 and the outward coating thickness 118 to vary properties of the substrate 101. For example, at increased diffusion treatment temperatures the inward coating thickness 117 may form 90% of the predetermined thickness 112 of the diffusion coating 102. The inward portion 107, which corresponds to the inward coating thickness 117, may provide decreased ductility, increased stability in an intermetallic phase, and/or increased oxidation and LCF properties as compared to the outward portion 108. In one embodiment, the decreased ductility of the inward portion 107 on the honeycomb seals 110 increases an abradability to extend a rotor life. In another embodiment, particular types and amounts of the metal powder and the activator influence the amount of the inward coating or the outward coating that is produced within the above-noted diffusion treatment temperature range.

In one example, the slurry 100 including, by weight, 40% of the metal powder, 10% $NH_4Cl$ as the activator, 30% of a stop-off (i.e., a mixture of the adhesive and the thickener), 10% of the ceramic, and 10% of the binder, is cured for 4 hours at a temperature of 2000° F. to form the diffusion coating 102 with the predetermined thickness 112 of between 1.1 mil (about 28 microns) and 1.6 mil (about 41 microns). The inward coating thickness being between 75% and 95% of the predetermined thickness 112, and the outward coating thickness 118 being between 5% and 25% of the predetermined thickness 112.

Figure 3:
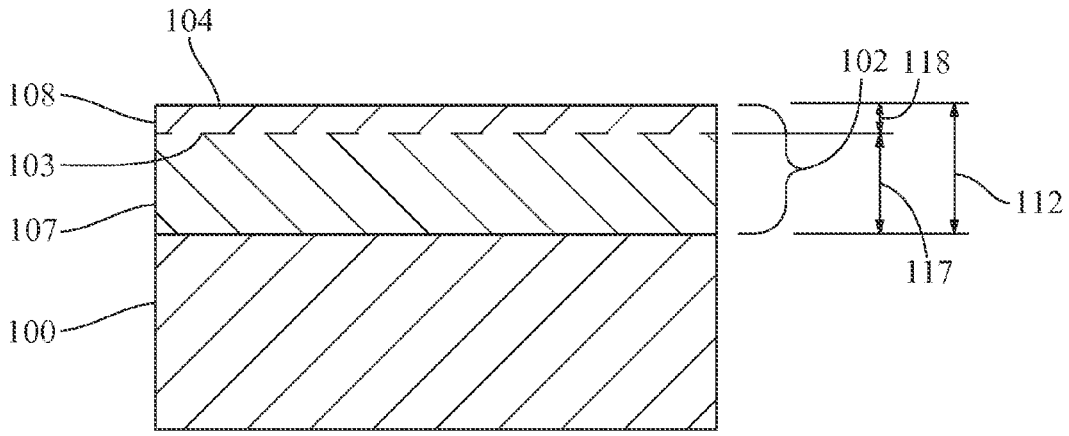
FIG. 3 shows a cross sectional view of a diffusion coating over a substrate with a coating residue removed according to an embodiment of the disclosure.

Referring to FIGS. 2 and 3, in one embodiment, during formation of the diffusion coating 102, the coating residue 111 is formed over the outward portion 108. The coating residue 111 includes remnants of the slurry coating 106, such as, but not limited to, ashes formed from burning the binder and the adhesive, ceramic powder remains, and/or metal powder remains. The metal powder remains include a different composition from the metal powder, as the metal powder undergoes a chemical composition change during the coating process. In another embodiment, the coating residue 111 is removed from the substrate surface 103 by any suitable method, such as, but not limited to, spraying the substrate 101 with a fluid (e.g., water, compressed air), rinsing the substrate 101 with a liquid (e.g., water), shaking the substrate 101, or a combination thereof. The ashes from the binder and the adhesive, as well as the ceramic powder remains, reduce or eliminate sintering of the metal powder, which facilitates removal of the coating residue 111.

Figure 4:
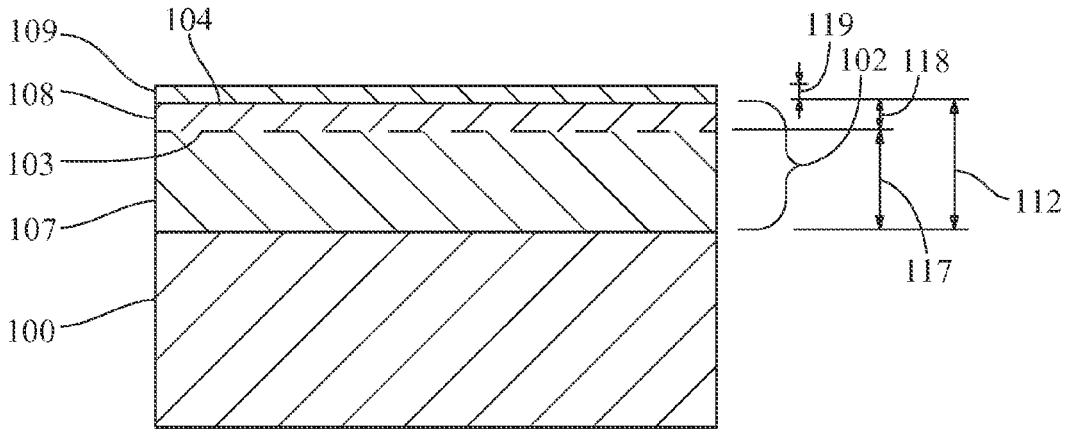
FIG. 4 shows a cross sectional view of an oxide layer formed over a diffusion coating according to an embodiment of the disclosure.
Figure 5:
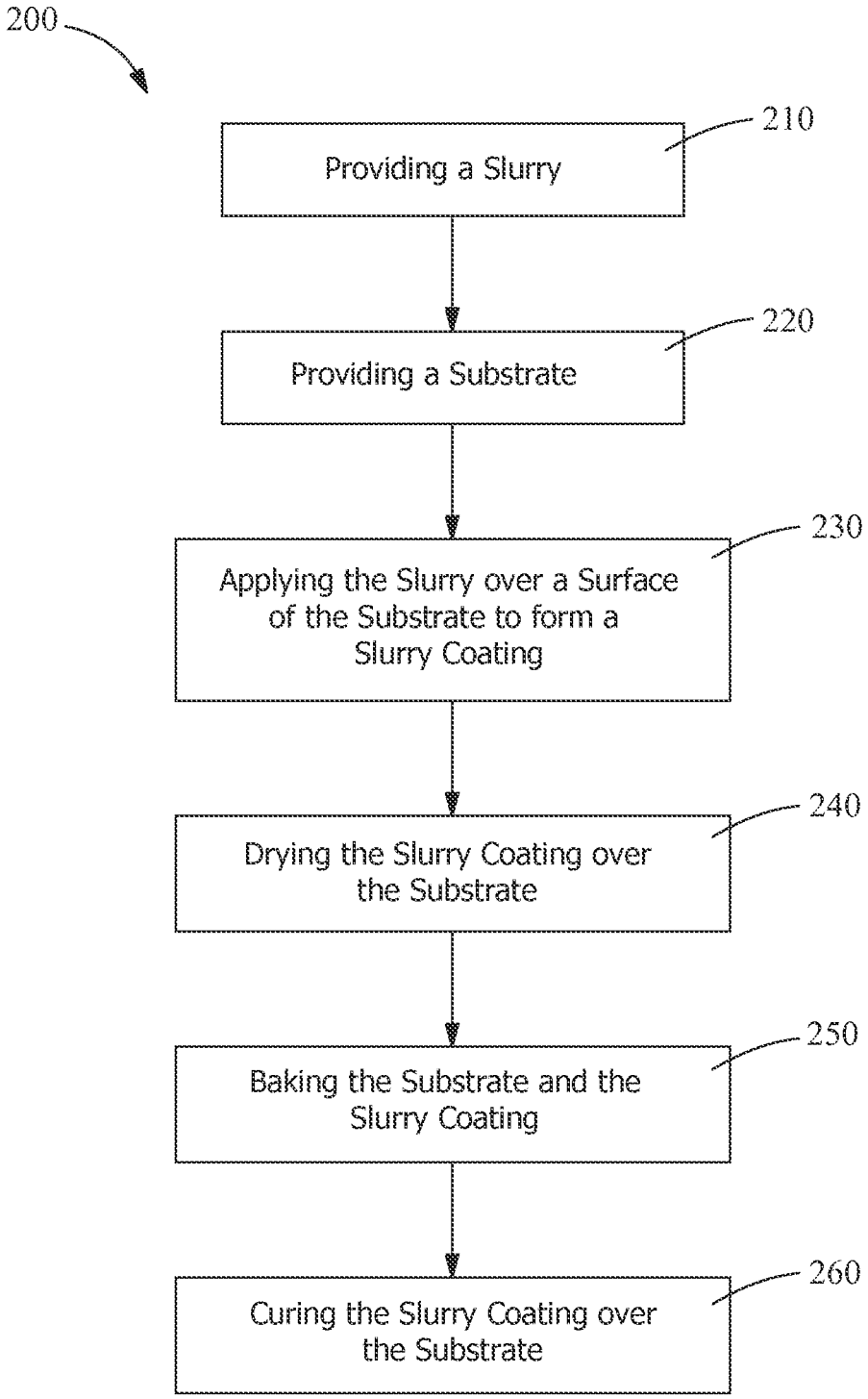
FIG. 5 is a flow chart of a coating method according to an embodiment of the disclosure.

Referring to FIG. 4, in another embodiment, the diffusion coating 102 includes an oxide layer 109 formed over the outward layer 108. The oxide layer 109 is generally very thin and includes an oxide layer thickness 119 of between 5 microns and 10 microns, between 6 microns and 9 microns, between 7 microns and 8 microns, or any combination, sub-combination, range, or sub-range thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A slurry for forming a diffusion coating on a surface of a component, the slurry comprising, by weight:

between 10% and 40% metal powder;

between 10% and 15% activator, exclusive of adhesive;

between 10% and 20% adhesive, exclusive of activator;

between 10% and 20% thickener, exclusive of ceramic;

up to 30% ceramic, the ceramic being present, exclusive of thickener; and up to 25% binder, the binder being present, exclusive of adhesive.

2. The slurry of claim 1, wherein the component comprises a superalloy.

3. The slurry of claim 1, wherein the metal powder comprises a metallic aluminum alloy.

4. The slurry of claim 1, wherein the activator comprises a halide activator.

5. The slurry of claim 4, wherein the halide activator is selected from the group consisting of methyl chloride, ammonium chloride, ammonium fluoride, and ammonium bromide.

6. The slurry of claim 1, wherein the adhesive is selected from the group consisting of a wet adhesive and a polyether.

7. The slurry of claim 6, wherein the polyether further comprises polyethylene oxide.

8. The slurry of claim 1, wherein the thickener comprises alumina.

9. The slurry of claim 1, wherein increasing an amount of the thickener increases a viscosity of the slurry.

10. The slurry of claim 1, wherein increasing an amount of the adhesive increases a viscosity of the slurry.

11. The slurry of claim 1, wherein the ceramic comprises a ceramic powder selected from the group consisting of zirconium oxide, boron nitride, titanium dioxide, and aluminum nitride.

12. The slurry of claim 1, wherein the binder comprises an organic polymer.

13. The slurry of claim 1, wherein increasing an amount of the binder decreases a viscosity of the slurry.

14. A slurry for forming a diffusion coating on a surface of a component, the slurry comprising, by weight:

between 10% and 40% Cr—Al powder;

between 10% and 15% activator, exclusive of polyethylene oxide;

between 10% and 20% polyethylene oxide, exclusive of activator;

between 10% and 20% thickener, exclusive of ceramic;

up to 30% ceramic, the ceramic being present, exclusive of thickener; and up to 25% organic polymer binder, the organic polymer binder being present, exclusive of adhesive.

15. A coating method, comprising:

providing a slurry comprising the composition of claim 1;

providing a substrate;

applying the slurry over a surface of the substrate to form a slurry coating;

drying the slurry coating over the substrate;

baking the substrate and the slurry coating; and curing the slurry coating over the substrate;

wherein curing the slurry coating over the substrate transfers metal elements of the metal powder in the slurry to the substrate to form a coating on the substrate.

16. The coating method of claim 15, further comprising increasing an amount of the adhesive in the slurry to increase a viscosity of the slurry and a rate of movement of the slurry over the surface of the substrate.

17. The coating method of claim 15, wherein baking the substrate and the slurry coating further comprises burning off the binder and the adhesive.

18. The coating method of claim 17, further comprising removing the ceramic from the slurry coating after baking the substrate and the slurry coating.

19. The coating method of claim 18, wherein removing the ceramic from the slurry coating further comprises rinsing the substrate and the slurry coating with a liquid.

20. The coating method of claim 15, further comprising forming the coated substrate without post heat-treating the substrate.

* * * * *